US006851370B2

(12) United States Patent
Reynolds et al.

(10) Patent No.: US 6,851,370 B2
(45) Date of Patent: Feb. 8, 2005

(54) INTEGRATED PLANAR SWITCH FOR A MUNITION

(75) Inventors: Richard K. Reynolds, Calistoga, CA (US); Andrew F. Cunningham, Seattle, WA (US); George N. Hennings, Ridgecrest, CA (US); Thomas M. Nickolin, Batavia, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 180 days.

(21) Appl. No.: 10/137,063

(22) Filed: Apr. 30, 2002

(65) Prior Publication Data

US 2003/0200890 A1 Oct. 30, 2003

(51) Int. Cl.[7] ..... F42C 19/12
(52) U.S. Cl. ..... 102/202.8; 102/202.7
(58) Field of Search ..... 102/202.5, 202.7, 102/218, 219, 202.8

(56) References Cited

U.S. PATENT DOCUMENTS 3,611,023 A * 10/1971 Souza, Jr. ..... 315/200
4,788,913 A * 12/1988 Stroud et al. ..... 102/202.5
4,928,595 A * 5/1990 Weingart ..... 102/202.7
5,080,016 A * 1/1992 Osher ..... 102/202.7
5,173,570 A * 12/1992 Braun ..... 102/347
5,431,104 A * 7/1995 Barker ..... 102/312
5,641,935 A * 6/1997 Hunter et al. ..... 102/206
5,756,926 A 5/1998 Bonbrake et al. ..... 102/215
5,969,286 A 10/1999 Ward et al. ..... 102/202.7
6,234,081 B1 * 5/2001 Neyer ..... 102/202.5
6,272,995 B1 8/2001 Schmidt et al. ..... 102/209
6,386,108 B1 * 5/2002 Brooks et al. ..... 102/217

* cited by examiner

*Primary Examiner*—Peter M. Poon
*Assistant Examiner*—Timothy D. Collins
(74) *Attorney, Agent, or Firm*—Harness, Dickey & Pierce, PLC

(57) ABSTRACT

A detonator for initiating a detonation event in an explosive charge. The detonator comprises an exploding foil initiator and a switch. The exploding foil initiator includes a detonator bridge with a bridge member and a bridge contact that are electrically coupled to one another. The switch includes a switch contact that is spaced apart from the detonator bridge such that a spark gap of a predetermined width is defined between the bridge contact and the switch contact. A discharge arc, which is formed when a voltage in excess of a predetermined gap breakdown voltage is applied across the spark gap, closes the switch to thereby permit current to flow between the bridge contact and the switch contact.

27 Claims, 6 Drawing Sheets

INTEGRATED PLANAR SWITCH FOR A MUNITION

FIELD OF THE INVENTION

The present invention generally relates to detonators and initiation firesets for initiating a detonation event in an explosive charge and more particularly to a detonator having switch for controlling the operation of an exploding foil initiator.

BACKGROUND OF THE INVENTION

Exploding foil initiators, which are also known as slappers, are employed to generate a shock wave to initiate a detonation event in an explosive charge. In a conventionally designed exploding foil initiator, a bridge member is connected to a power source through two relatively wide conductive lands. The power source is typically a capacitor whose discharge is governed by a high voltage switch. When the switch closes, the capacitor provides sufficient electric current to change the bridge member from solid to a plasma. The pressure of the plasma drives a flyer or pellet into contact with the explosive charge, thereby generating the shock wave and initiating the detonation event.

The heretofore known high voltage switches for use with exploding foil initiators, which include vacuum spark gap switches and solid state switches, tend to be relatively expensive and bulky. While the cost and size of such switches is not necessarily prohibitive for relatively large and expensive munitions, such as guided missiles, cost and packaging concerns have substantially precluded the use of exploding foil initiators in smaller, more commonly used munitions. Accordingly, there remains a need in the art for a highly reliable, yet relatively small and inexpensive detonator that utilizes an exploding foil initiator.

SUMMARY OF THE INVENTION

In one preferred form, the present invention provides a detonator for initiating a detonation event in an explosive charge. The detonator comprises an exploding foil initiator and a switch. The exploding foil initiator includes a detonator bridge with a bridge member and a bridge contact that are electrically coupled to one another. The switch includes a switch contact that is spaced apart from the detonator bridge such that a spark gap of a predetermined width is defined between the bridge contact and the switch contact. A discharge arc, which is formed when a voltage in excess of a predetermined gap breakdown voltage is applied across the spark gap, closes the switch to thereby permit current to flow between the bridge contact and the switch contact. The detonator of the present invention essentially integrates the switch into the exploding foil initiator to thereby provide a highly reliable and relatively inexpensive detonator. In this regard, the detonator of the present invention permits the exploding foil initiator and the switch to be provided in a hermetic package with a controlled atmosphere to ensure reliable and repeatable operation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
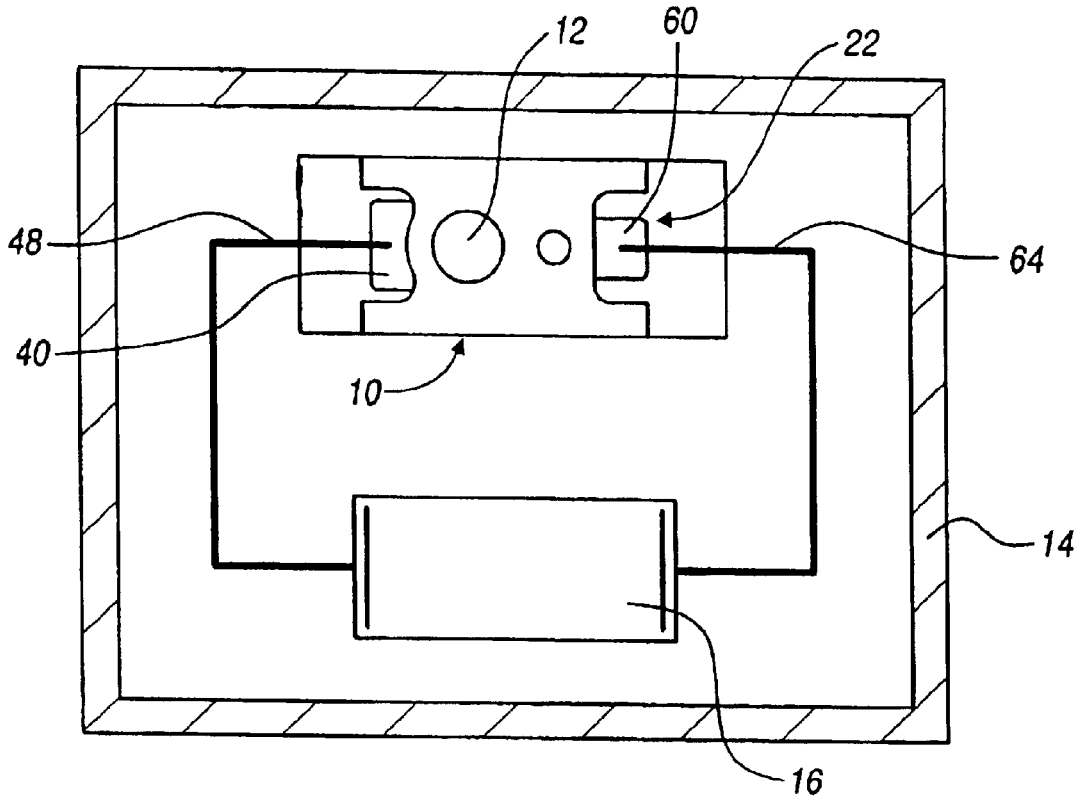
FIG. 1 is a schematic view of a detonator constructed in accordance with the teachings of the present invention.
Figure 2:
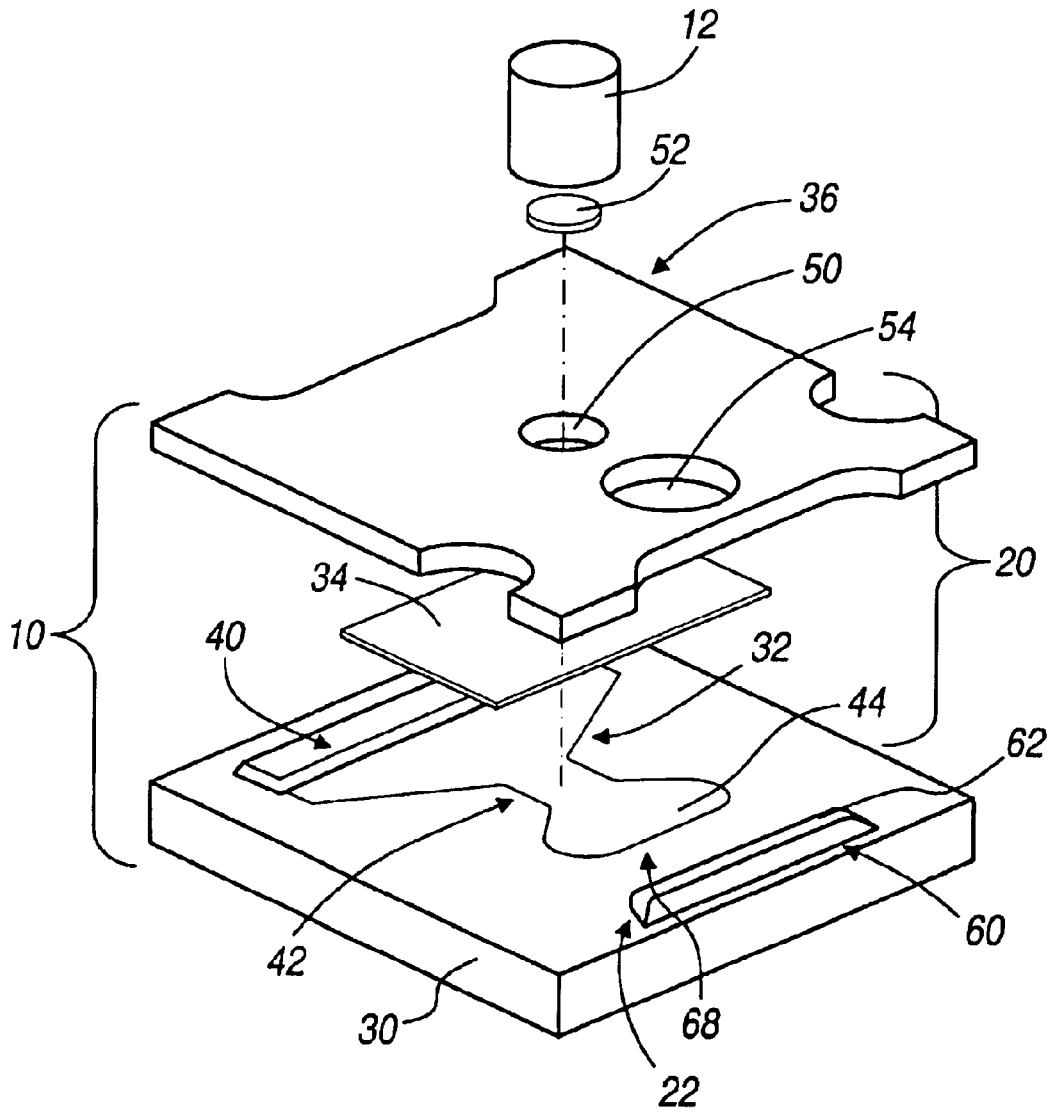
FIG. 2 is an exploded perspective view of a portion of the detonator of FIG. 1 illustrating the exploding foil initiator and the switch.

With reference to FIGS. 1 and 2 of the drawings, a detonator constructed in accordance with the teachings of the present invention is generally indicated by reference numeral 10. The detonator 10 is employed to initiate a detonation event in an explosive charge 12. The explosive charge 12 is preferably a secondary explosive material, such as pentaerythritol tetranitrate (PETN), cyclotrimethylenetrinitramine (RDX), trinitrotoluene (TNT) or hexanitro stilbene (HNS), but may alternatively be a primary explosive, such as mercury fulminate, lead styphnate or lead azide. The detonator 10 is also illustrated as being disposed in a sealed housing 14 and operatively associated with a source of electrical energy 16, such as a capacitor. The housing 14 is preferably sealed, for example with a hermetic seal, so that both the detonator 10 and the explosive charge 12 are impervious to moisture, dirt, contaminants or changes in atmospheric pressure or composition, which may detrimentally effect their operation.

With additional reference to FIG. 2, the detonator 10 is shown to include an exploding foil initiator 20 and a switch 22. The exploding foil initiator 20 includes a base 30, a detonator bridge 32, a flyer layer 34 and a barrel layer 36. The base 30 is formed from an electrically insulating material, such as ceramic, glass, polyimide or silicon.

The detonator bridge 32, which is unitarily formed from a suitable electric conductor, such as copper, gold, silver and/or alloys thereof, is fixedly coupled to or formed onto the base 30 in an appropriate manner, such as chemical or mechanical bonding or metallization. In the example provided, the detonator bridge 32 includes a base layer of copper or nickel that is covered by an outer layer of gold. The detonator bridge 32 includes a bonding pad 40, a bridge member 42, a bridge contact 44, all of which are electrically coupled to one another. The bonding pad 40 serves as an electrical terminal that permits the detonator bridge 32 to be coupled to the source of electrical energy 16 through one or more bond wires 48. The bridge member 42 is disposed between the bonding pad 40 and the bridge contact 44 and is necked down relative to the remainder of the detonator bridge 32 so as to promote its transition from a solid state to a gaseous or plasma state when an electric current that exceeds a threshold current flows through the detonator bridge 32.

The flyer layer 34 is formed from a suitable electrically insulating material, such as polyimide or parylene, and overlies a portion of the detonator bridge 32 that includes the bridge member 42. The barrel layer 36, which is formed from an electrically insulating material, such as a polyimide film, is bonded to the base 30 to maintain the flyer layer 34 in a juxtaposed relation with the detonator bridge 32 and the barrel layer 36. A barrel aperture 50 is formed in the barrel layer 36 in an area that is situated directly above and in-line with the bridge member 42 and provides a route by which a sheared pellet or flyer 52 may impact the explosive charge 12 and initiate the detonation event. The barrel layer 36 also includes a spark aperture 54 that will be discussed in greater detail, below.

In the particular embodiment illustrated, the switch 22 includes a switch bonding pad 60 and a switch contact 62. The switch bonding pad 60 serves as an electrical terminal that permits the switch 22 to be coupled to an opposite side of the source of electrical energy 16 through one or more bond wires 64. The switch contact 62 is spaced apart from the detonator bridge 32 so as to define a spark gap 68 of a predetermined width between the bridge contact 44 and the switch contact 62. The spark gap 68 may be about 0.075 mm (0.003 inch) to about 1.016 mm (0.040 inch), but is preferably about 0.2 mm (0.008 inch) to about 0.5 mm (0.020 inch).

Figure 3:
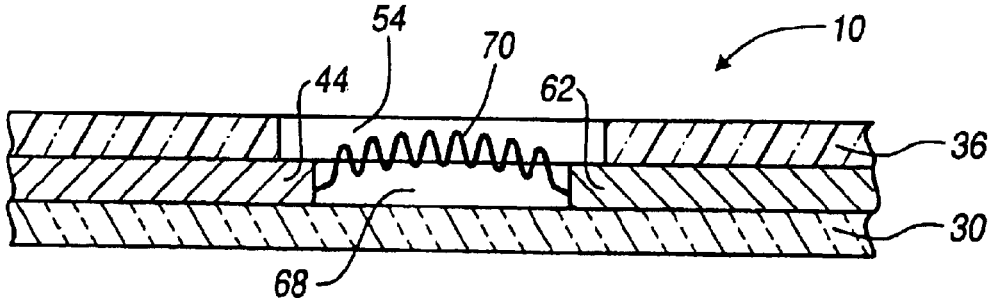
FIG. 3 is a longitudinal section view of a portion of the detonator of FIG. 1 illustrating the formation of a discharge arc over the spark gap.

With additional reference to FIG. 3, the source of electrical energy 16 is employed to apply a biasing voltage across the bridge contact 44 and the switch contact 62. When the biasing voltage exceeds a predetermined gap breakdown voltage, a discharge arc 70 is formed across the spark gap 68. The discharge arc 70 electrically couples the bridge contact 44 and the switch contact 62 and permits a sufficient amount of electrical current to flow through the detonator bridge 32 such that the physical state or phase of the bridge member 42 is very rapidly changed from a solid state to a plasma state. During the phase change of the bridge member 42, sufficient pressure is generated between the base 30 and the flyer layer 34 to drive the flyer layer against the barrel layer 36 in the vicinity of the barrel aperture 50 and shear a flyer 52 from the flyer layer 34. The pressure generated by the phase change of the bridge member 42 propels the flyer 52 through the barrel aperture 50 and into contact with the explosive charge 12. The shock wave that is produced when the flyer 52 impacts the explosive charge 12 initiates a detonation event in the explosive charge 12.

Those skilled in the art will appreciate that as both the detonator bridge 32 and the switch 22 are contained in the hermetically sealed housing 14, the detonator 10 is extremely reliable and relatively impervious to contaminants such as moisture and dirt. Those skilled in the art will also appreciate that as the both the detonator bridge 32 and the switch 22 are coupled to the base 30, the cost of the switch 22 is substantially reduced as compared to prior art switches, since the detonator bridge 32 and the switch 22 may be simultaneously formed. Furthermore, the coupling of the detonator bridge 32 and the switch 22 to the base 30 substantially reduces concerns for the packaging of the detonator 10 into a munition (not shown).

As noted above, the width of the spark gap 68 is preferably about 0.2 mm (0.008 inch) to about 0.5 mm (0.020 inch), and as such, the source of electrical energy 16 would have to generate a biasing voltage across the bridge contact 44 and the switch contact 62 of about 1200 volts to about 2500 volts to initiate the breakdown (i.e., overvoltage breakdown) of the spark gap 68. Those skilled in the art will understand, however, that the magnitude of the gap breakdown voltage will vary with the width of the spark gap 68 and as such, the magnitude of the gap breakdown voltage may be affected in a desired manner by increasing or decreasing the width of the spark gap 68. Other factors determining the breakdown voltage include the geometric shapes of the bridge contact 44 and the switch contact 62 and the surface roughness of the metal that forms the bridge contact 44 and the switch contact 62.

Figure 4:
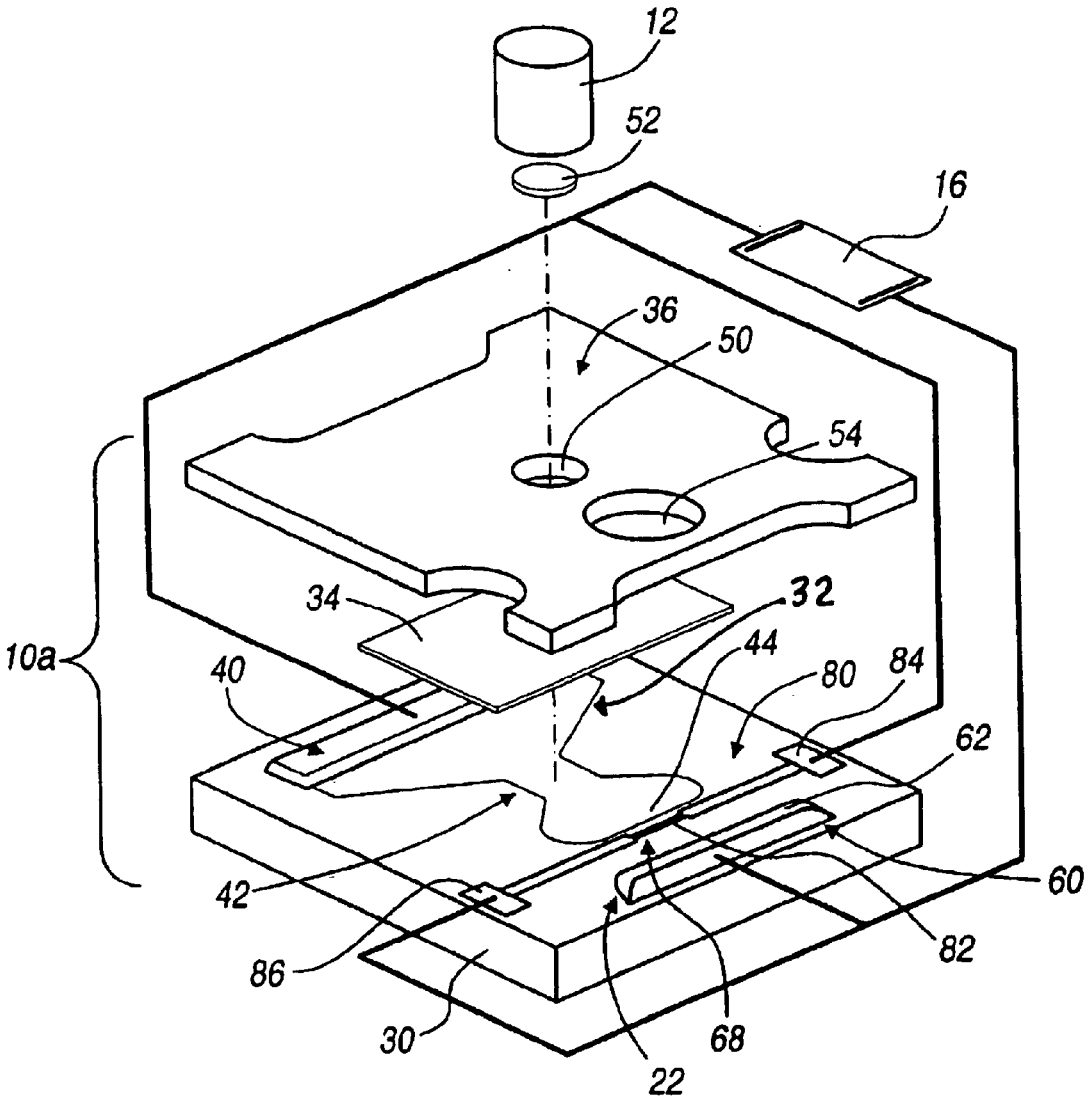
FIG. 4 is an exploded perspective view similar to that of FIG. 2 but illustrating a detonator constructed in accordance with the teachings of a second embodiment of the present invention.

While the detonator 10 has been described thus far as including a single switch for initiating a detonation event, those skilled in the art will appreciate that the invention, in its broader aspects, may be constructed somewhat differently. For example, a secondary switch may be incorporated into the detonator as illustrated in FIG. 4. In this arrangement, the detonator 10*a* is generally similar to the detonator 10 of FIG. 2 except for the inclusion of a secondary switch 80. The secondary switch 80 is operable in a first condition and a second condition. Operation of the secondary switch 80 in the first condition does not affect the operation of the switch 22, such that the switch 22 is closed only by the formation of a discharge arc in response to the application of a voltage across the bridge contact 44 and the switch contact 62 in excess of the gap breakdown voltage. Operation of the secondary switch 80 in the second condition affects the operation of the switch 22 such that the switch is closed at a voltage that is less than the gap breakdown voltage.

In the embodiment illustrated, the secondary switch 80 includes a switch element 82 that changes its state or phase when the secondary switch 80 is positioned in the second condition to shorten an effective width of the spark gap 68. Preferably, the switch element 82 is normally in a solid state when the secondary switch 80 is positioned in the first condition and changes to a plasma state when the secondary switch 80 is positioned in the second condition.

The secondary switch 80 of the example provided is illustrated to include a first terminal 84 and a second terminal 86 that are electrically coupled to the opposite ends of the switch element 82. The first and second terminals 84 and 86 are in turn, coupled to a power source, such as the source of electrical energy 16. Those skilled in the art will understand, however, that a discrete, second source of electrical energy may alternatively be employed to provide electrical power to the secondary switch 80.

When the detonator 10*a* is to be activated, electrical power is transmitted through the secondary switch 80, causing the switch element 82 to change states and shorten the effective width of the spark gap 68. The shortening of the effective width of the spark gap 68 permits a discharge arc to be formed at a biasing voltage that is less than the gap breakdown voltage. Accordingly, positioning of the secondary switch 80 into the second condition permits the detonation event to occur when the biasing voltage is less than the gap breakdown voltage.

Figure 5:
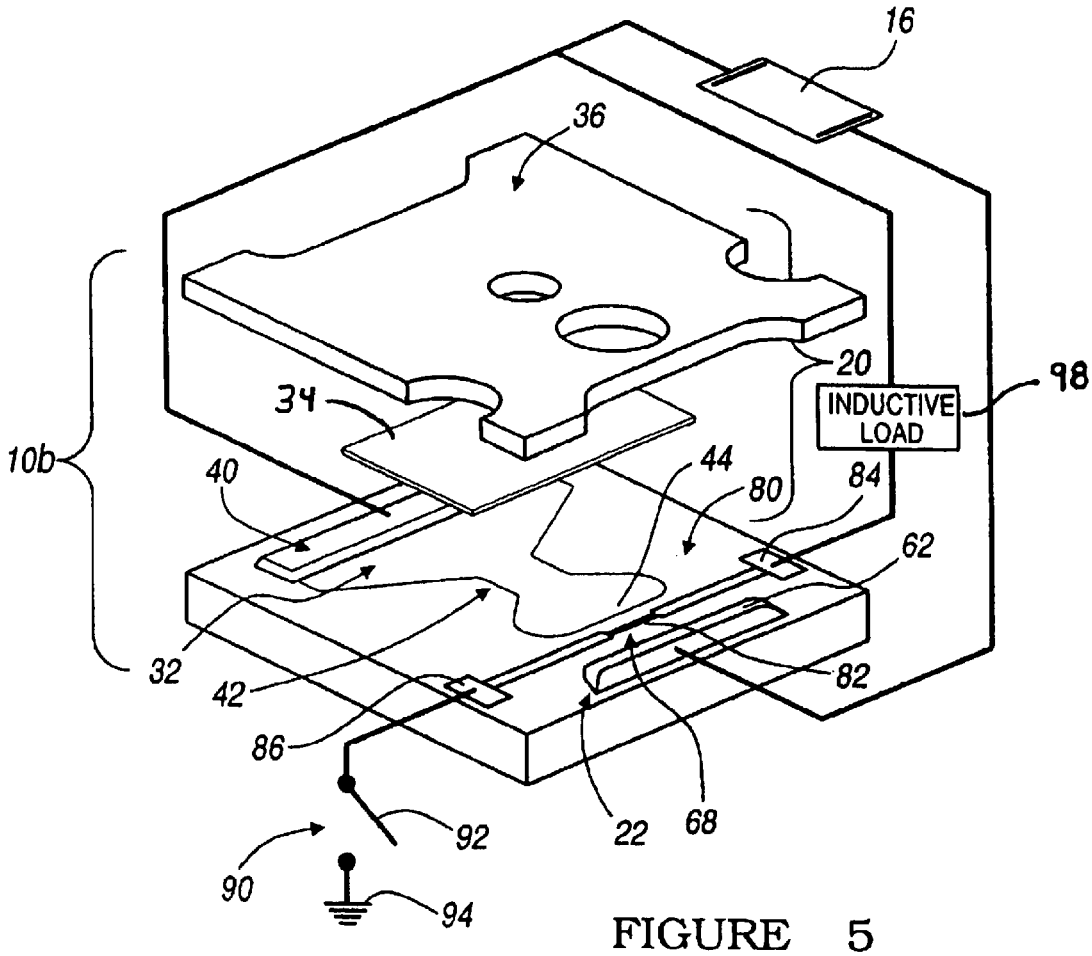
FIG. 5 is an exploded perspective view similar to that of FIG. 2 but illustrating a detonator constructed in accordance with the teachings of a third embodiment of the present invention.

The detonator 10*b* of FIG. 5 is substantially similar to the detonator 10*a* of FIG. 4, except for the addition of an auxiliary switch 90. The auxiliary switch 90 includes an auxiliary switch element 92 that is movable between a grounded condition, which electrically couples the second terminal 86 to an electrical ground 94, and an open condition, which inhibits current from flowing between the second terminal 86 and the electrical ground 94. The detonator bridge 32 and the secondary switch 80 are illustrated to be electrically coupled to the source of electrical energy 16, which produces a biasing voltage that is less than the gap breakdown voltage. With the auxiliary switch 90 positioned in the open condition, electrical current is not able to flow through the switch element 82 and the switch element 82 remains in a state that does not affect the effective width of the spark gap 68. When the auxiliary switch 90 is positioned in the grounded condition, however, electrical current flows through the switch element 82, causing the switch element 82 to change states and shorten the effective width of the spark gap 68. The operation of the detonator 10*b* is otherwise identical to the operation of the detonator 10*a*. In the example provided, a load device 98 is disposed in series between the first terminal 84 and the source of electrical energy 16 to limit the current that is passed through the auxiliary switch 90. In the example provided, the load device 98 has an impedance of at least about 50 ohms, and preferably an impedance of about 50 ohms to about 60 ohms. Alternately, the load device 98 may be configured to capacitively couple the auxiliary switch 90 and the source of electrical energy 16 with a capacitance of 1% to 10% of the source of electrical energy 16 when the source of electrical energy 16 is a capacitor.

Figure 6:
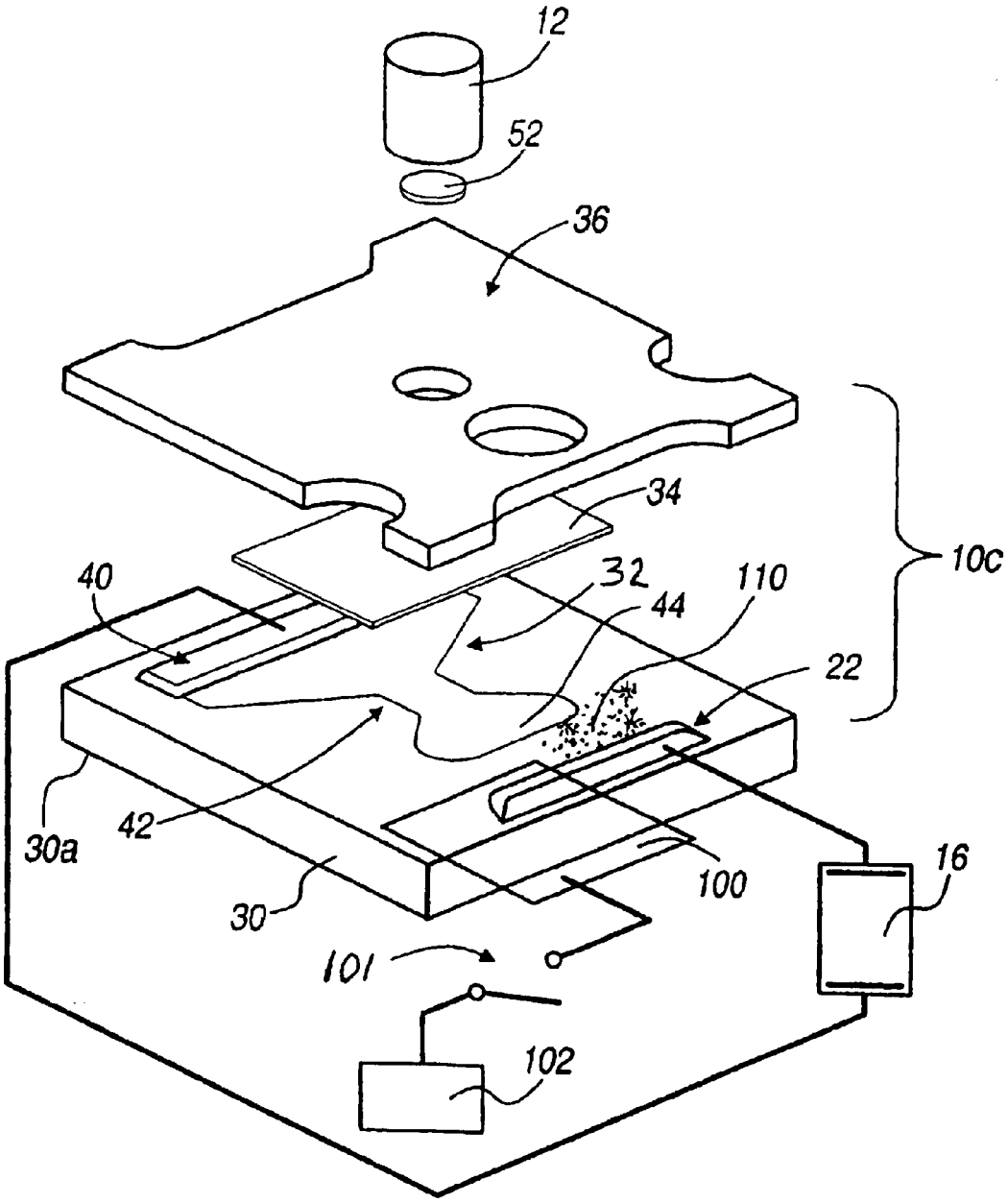
FIG. 6 is an exploded perspective view similar to that of FIG. 2 but illustrating a detonator constructed in accordance with the teachings of a fourth embodiment of the present invention.

The detonator 10*c* of FIG. 6 is similar to the detonator 10 of FIG. 2, expect that the detonator 10*c* includes an auxiliary switch 101 with a conductive pad 100 and a voltage source 102. The conductive pad 100 can be coupled to the bottom surface 30*a* of the base 30 and in the particular embodiment illustrated is formed in a metallization process. The voltage source 102 is coupled to the conductive pad 100 and is selectively controllable to apply a charge, as through a pulse of electricity that may have a positive or negative charge, to the conductive pad 100 to produce an auxiliary electric field that distorts the electric field 110 between the bridge contact 44 and the switch contact 62. As those skilled in the art will appreciate, sufficient distortion of the electric field 110 will initiate the formation of a discharge arc at a biasing voltage that is less than the gap breakdown voltage. Those skilled in the art will also understand that distortion of the electric field 110 may also be achieved through the creation of a magnetic field.

Figure 7:
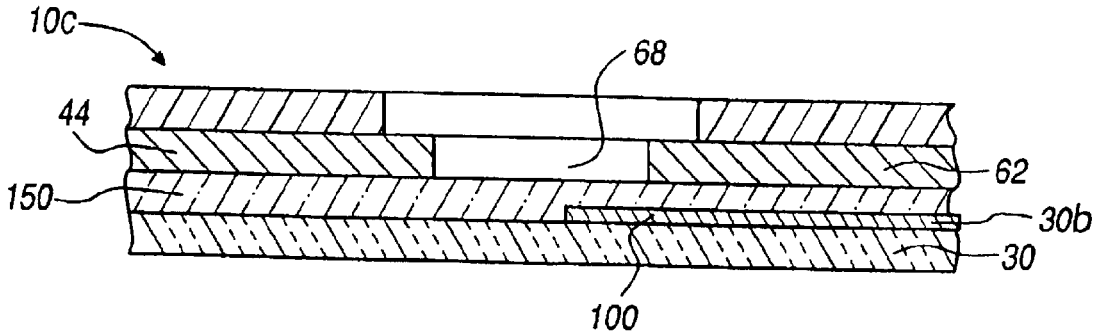
FIG. 7 is a longitudinal section view of a portion of a detonator constructed in accordance with the teachings of an alternate embodiment of the fourth embodiment of the present invention.

As those skilled in the art will appreciate, the conductive pad 100 may additionally or alternatively be formed on the top surface 30*b* of the base 30 as shown in FIG. 7. In the particular example provided, the conductive pad 100 is formed in a metallization process, and then covered with an insulating layer 150, such as polyimide, that extends only partially over the conductive pad 100 so as to facilitate, via a wire (not shown) an electrical connection between the conductive pad 100 and the voltage source 102 (FIG. 6). The remainder of the detonator 10*c* may be built up onto the insulating layer 150 as if the insulating layer 150 was the top surface 30*b* of the base 30.

Figure 8:
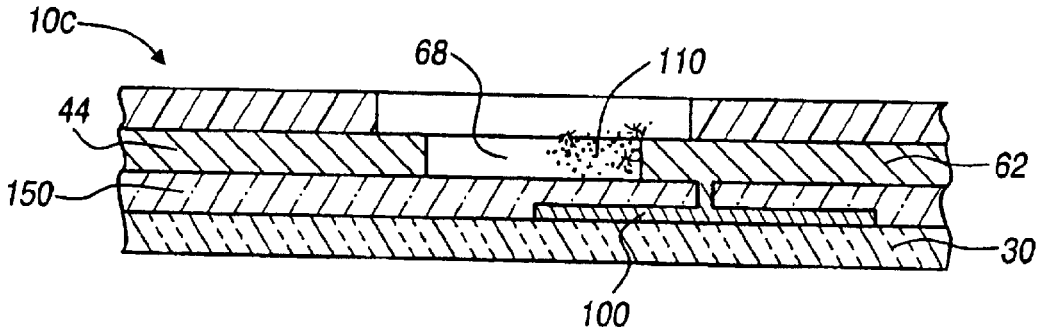
FIG. 8 is a longitudinal section view of a portion of a detonator constructed in accordance with the teachings of another alternate embodiment of the fourth embodiment of the present invention.

Those skilled in the art will also appreciate that the conductive pad 100 described above may also be electrically coupled to one side of the spark gap 68, as illustrated in FIG. 8, in order to change or redistribute the electrical field 110 around the spark gap 68 during overvoltage breakdown, when the detonator 10*c* is operated in simple breakdown mode or with a secondary trigger switch. This redistribution of the electric field 110 may result in benefits such as more reliable spark initiation as well as increased probability of multi-channel arc formation with a subsequent decrease in switch impedance.

Figure 9:
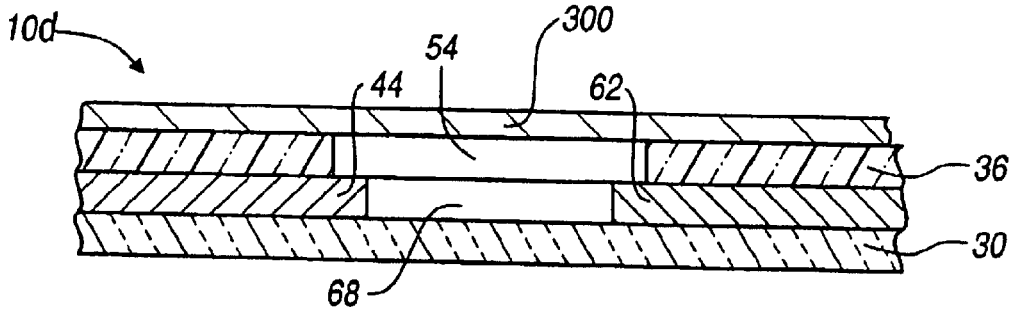
FIG. 9 is a longitudinal section view of a portion of a detonator constructed in accordance with the teachings of a fifth embodiment of the present invention.

In the embodiment of FIG. 9, the detonator 10*d* is generally similar to the detonator 10, except for the addition of a protective material 300, which may also be an insulating material such as a polyimide film. The protective material 300 is bonded to the barrel layer 36 and cooperates with the other layers of the detonator 10*d* to fully enclose the spark gap 68. Construction of the detonator 10*d* in this manner eliminates concerns for low voltage breakdown of the spark gap 68 as a result of contamination during the manufacture of the detonator 10*d*. Furthermore, this embodiment may provide more efficient triggering due to the confinement of the plasma in the proximity of the switch gap 68.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A detonator for initiating a detonation of an explosive charge, the detonator comprising an exploding foil initiator and a switch, the exploding foil initiator having a detonator bridge with a bridge member and a bridge contact that are electrically coupled to one another, the switch having a switch contact, said switch being defined by the switch contact and the bridge contact, the switch contact being spaced apart from the detonator bridge such that a spark gap of a predetermined width is defined between the bridge contact and the switch contact;

wherein a discharge arc closes the switch to thereby permit current to flow between the bridge contact and the switch contact, the discharge arc being formed across the spark gap and between the bridge contact and the switch contact when a voltage in excess of a predetermined gap breakdown voltage is applied across the spark gap.

2. The detonator of claim 1, further comprising a secondary switch that is operable in a first condition which does not affect the operation of the switch such that the switch is closed only by the formation of the discharge arc in response to the application of a voltage across the bridge contact and the switch contact in excess of the gap breakdown voltage, the secondary switch also being operable in a second condition which affects the operation of the switch such that the switch is closed at a voltage that is less than the gap breakdown voltage.

3. The detonator of claim 2, wherein the secondary switch has a switch element that is disposed within the spark gap, the switch element changing states when the secondary switch is positioned in the second condition to shorten the width of the spark gap.

4. A detonator for initiating a detonation of an explosive charge, the detonator comprising:

an exploding foil initiator having a detonator bridge with a bridge member and a bridge contact that are electrically coupled to one another;

a switch having a switch contact, the switch contact being spaced apart from the detonator bridge such that a spark gap of a predetermined width is defined between the bridge contact and the switch contact; and a secondary switch having a switch element that is disposed within the spark gap, the switch element changing states when the secondary switch is positioned in the second condition to shorten the width of the spark gap, the secondary switch being operable in a first condition which does not affect the operation of the switch such that the switch is closed only by the formation of the discharge arc in response to the application of a voltage across the bridge contact and the switch contact in excess of the gap breakdown voltage, the secondary switch also being operable in a second condition which affects the operation of the switch such that the switch is closed at a voltage that is less than the gap breakdown voltage, said switch element being in a solid state when the secondary switch is positioned in the first condition and the switch element changing to a plasma state when the secondary switch is positioned in the second condition;

wherein a discharge arc closed the switch to thereby permit current to flow between the bridge contact and the switch contact, the discharge arc being formed when a voltage in excess of a predetermined gap breakdown voltage is applied across the spark gap.

5. The detonator of claim 4, wherein the secondary switch includes a first terminal and a second terminal, the first terminal being electrically coupled to the bridge contact and a first end of the switch element, the second terminal being electrically coupled to a second end of the switch element and an auxiliary switch, the auxiliary switch including an auxiliary switch element that is movable between a grounded condition, which electrically couples the second terminal to an electrical ground, and a open condition which inhibits current from flowing between the second terminal and the electrical ground.

6. The detonator of claim 5, wherein the secondary switch further comprises an electric load device that is coupled in series between the first terminal and the bridge contact.

7. The detonator of claim 6, wherein the electric load device has an impedance of at least 50 ohms.

8. The detonator of claim 6, further comprising a capacitor for providing a source of electrical energy to the bridge contact, the capacitor having a predetermined capacitance, the load device capacitively coupling the auxiliary switch to the capacitor with a capacitance of about 1% of the predetermined capacitance to about 10% of the predetermined capacitance.

9. The detonator of claim 2, wherein application of a voltage across the bridge contact and the switch contact generates an electric field, the electric field being affected when the secondary switch is changed from the first condition to the second condition to distort the electric field and thereby initiate a formation of the discharge arc.

10. The detonator of claim 9, wherein placement of the secondary switch into the second condition releases a pulse of energy that is employed to produce at least one of an auxiliary electric field and a magnetic field to distort the electric field.

11. The detonator of claim 10, wherein the secondary switch includes an electrically charged conductive pad that is disposed proximate one of the bridge contact and the switch contact.

12. The detonator of claim 10, wherein the secondary switch includes a conductive pad that is electrically coupled to one of the bridge contact and the switch contact.

13. The detonator of claim 1, wherein the detonator bridge and the switch contact are coupled to a base that is formed from an electrically insulating material and wherein the base is coupled to a first side of the detonator bridge and a flyer layer is coupled to a second layer of the detonator bridge, the flyer layer being formed of an electrically insulating material and covering the bridge member.

14. The detonator of claim 13, wherein at least a portion of the flyer is juxtaposed between the detonator bridge and a barrel layer, the barrel layer being coupled to the base and formed from an electrically insulating material.

15. A detonator for initiating a detonation of an explosive charge, the detonator comprising:

an exploding foil initiator having a detonator bridge with a bridge member and a bridge contact that are electrically coupled to one another;

a flyer layer being formed of an electrically insulating material, said flyer layer covering the bridge member;

a switch having a switch contact, the switch contact being spaced apart from the detonator bridge such that a spark gap of a predetermined width is defined between the bridge contact and the switch contact;

barrel layer being formed from an electrically insulating material, wherein at least a portion of the flyer layer is juxtaposed between the detonator bridge and the barrel layer, wherein a spark aperture is formed in the barrel layer;

a base being formed from an electrically insulating material, said base being coupled to said detonator bridge, said switch contact and said barrel layer, said base being further coupled to a first side of the detonator bridge, said flyer layer being coupled to a second side of the detonator bridge, wherein a discharge arc closes the switch to thereby permit current to flow between the bridge contact arc and the switch contact, the discharge arc being formed between the bridge contact and the switch contact in the spark aperture when a voltage in excess of a predetermined gap breakdown voltage is applied across the spark gap;

said spark aperture being sized such that the barrel layer does not overlie the bridge contact, the spark gap and the switch contact in the area proximate the discharge arc.

16. The detonator of claim 13, wherein the detonator bridge and the switch contact are simultaneously formed onto the base.

17. The detonator of claim 1, further comprising a housing into which the exploding foil initiator and the switch are hermetically sealed.

18. A detonator for initiating a detonation of an explosive charge, the detonator comprising:

an exploding foil initiator having a base, a detonator bridge, a flyer layer and a barrel layer, the base being formed from an electrically insulating member, the detonator bridge having a detonator bridge with a bridge member and a bridge contact that are electrically coupled to one another, the flyer layer overlying the bridge member, the barrel layer overlying the flyer layer and being coupled to the base; and a switch having a switch contact, said switch being defined by the switch contact and the bridge contact, the switch being formed onto the base in a spaced apart relation with the detonator bridge such that a spark gap of a predetermined width is defined between the bridge contact and the switch contact;

wherein a discharge arc closes the switch to thereby permit current to flow between the bridge contact and the switch contact, the discharge arc being formed across the spark gap and between the bridge contact and the switch contact when a voltage in excess of a predetermined gap breakdown voltage is applied across the spark gap.

19. A detonator for initiating a detonation of an explosive charge, the detonator comprising:

an exploding foil initiator having a base, a detonator bridge, a flyer layer and a barrel layer, the base being formed from an electrically insulating member, the detonator bridge having a detonator bridge with a bridge member and a bridge contact that are electrically coupled to one another, the flyer layer overlying the bridge member, the barrel layer overlying the flyer layer and being coupled to the base; and a switch having a switch contact that is formed onto the base in a spaced apart relation with the detonator bridge such that a spark gap of a predetermined width is defined between the bridge contact and the switch contact;

wherein a discharge arc closes the switch to thereby permit current to flow between the bridge contact and the switch contact, the discharge arc being formed when a voltage in excess of a predetermined gap breakdown voltage is applied across the spark gap, wherein a spark aperture is formed in the barrel layer, the spark aperture being sized such that the barrel layer does not overlie the bridge contact, the spark gap and the switch gap contact in an area proximate the discharge arc.

20. The detonator of claim 18, further comprising a housing into which the exploding foil initiator and the switch are hermetically sealed.

21. The detonator of claim 18, further comprising a secondary switch that is operable in a first condition which does not affect the operation of the switch such that the switch is closed only by the formation of the discharge arc in response to the application of a voltage across the bridge contact and the switch contact in excess of the gap breakdown voltage, the secondary switch also being operable in a second condition which affects the operation of the switch such that the switch is closed at a voltage that is less than the gap breakdown voltage.

22. The detonator of claim 21, wherein the secondary switch has a switch element that is disposed within the spark gap, the switch element changing states when the secondary switch is positioned in the second condition to shorten the width of the spark gap.

23. The detonator of claim 21, wherein application of a voltage across the bridge contact and the switch contact generates an electric field, the electric field being affected when the secondary switch is changed from the first condition to the second condition to distort the electric field and thereby initiate a formation of the discharge arc.

24. The detonator of claim 15, further comprising a protective layer overlying the barrel layer to thereby confine the spark gap from a side opposite the base.

25. The detonator of claim 24, wherein the protective layer is formed from an electrically insulating material.

26. The detonator of claim 19, further comprising a protective layer overlying the barrel layer to thereby confine the spark gap from a side opposite the base.

27. The detonator of claim 26, wherein the protective layer is formed from an electrically insulating material.

* * * * *

UNITED STATES PATENT AND TRADEMARK OFFICE

CERTIFICATE OF CORRECTION

PATENT NO. : 6,851,370 B2
DATED : February 8, 2005
INVENTOR(S) : Richard K. Reynolds et al.

It is certified that error appears in the above-identified patent and that said Letters Patent is hereby corrected as shown below:

Column 3,
Line 66, delete the first occurrence of "the"

Column 7,
Line 27, delete "closed" and substitute -- closes -- therefor
Line 40, delete "a" and substitute -- an -- therefor Column 9,
Line 36, delete "gap"

Signed and Sealed this

Fifth Day of July, 2005

JON W. DUDAS
*Director of the United States Patent and Trademark Office*